US010441016B2

(12) United States Patent
Byrd

(10) Patent No.: US 10,441,016 B2
(45) Date of Patent: Oct. 15, 2019

(54) INSERT TO HOLD ARTICLES IN A CAP

(71) Applicant: Gary M. Byrd, St. Louis, MO (US)

(72) Inventor: Gary M. Byrd, St. Louis, MO (US)

( * ) Notice: Subject to any disclaimer, the term of this patent is extended or adjusted under 35 U.S.C. 154(b) by 451 days.

(21) Appl. No.: 14/812,875

(22) Filed: Jul. 29, 2015

(65) Prior Publication Data

US 2016/0029728 A1 Feb. 4, 2016

Related U.S. Application Data

(60) Provisional application No. 62/030,161, filed on Jul. 29, 2014.

(51) Int. Cl.
*A42B 1/24* (2006.01)

(52) U.S. Cl.
CPC ..... *A42B 1/24* (2013.01)

(58) Field of Classification Search
CPC ..... A42B 1/24
USPC ..... 224/181; 2/195.5, 181
See application file for complete search history.

(56) References Cited

U.S. PATENT DOCUMENTS 440,367 A * 11/1890 Promis ..... A42B 1/24 2/181.4
603,051 A * 4/1898 Bahan ..... A42B 1/24 131/257
858,349 A * 6/1907 Phillippi ..... A42B 1/24 2/181.4
897,027 A * 8/1908 Short ..... A42B 1/24 2/181.4
933,473 A * 9/1909 Leopold ..... A42B 1/24 2/181
954,740 A * 4/1910 Katterheinrich ..... A42B 1/24 206/243
1,198,105 A * 9/1916 Butler ..... A01K 1/0023 24/3.12
1,418,217 A * 5/1922 Warner ..... A42B 1/24 206/101
1,497,524 A * 6/1924 Wilson ..... A42B 1/24 132/121
1,614,021 A * 1/1927 Sprenger ..... B42F 19/00 40/360
2,577,717 A * 12/1951 Stevens ..... A42B 1/248 2/181
2,740,567 A * 4/1956 Kaufman ..... A42B 1/002 2/195.5
3,578,736 A * 5/1971 Dootson ..... A42C 5/02 2/181
5,481,760 A * 1/1996 Wood, Jr. ..... A42B 1/061 2/181.4
D374,114 S * 10/1996 Arroyo ..... D16/311
5,581,813 A * 12/1996 Henschel ..... A42B 1/248 2/195.1

(Continued)

*Primary Examiner* — Nathan J Newhouse
*Assistant Examiner* — Lester L Vanterpool
(74) *Attorney, Agent, or Firm* — David E. Crawford; Crawford IP Law

(57) ABSTRACT

An insert to hold an article, such as keys, credit cards, money, etc. in a cap is described. The cap may be worn by a user with the insert in place in the cap. The insert includes a head side surface generally opposite of a cap side surface. A first lateral side is generally opposite of a second lateral side. An upper edge is generally opposite of a lower edge. An extension extends from the upper edge. The extension defines a holding region.

20 Claims, 9 Drawing Sheets

(56) References Cited

U.S. PATENT DOCUMENTS

| | | | | | |
|---|---|---|---|---|---|
| 5,724,678 | A * | 3/1998 | McCallum | A42B 1/241 | 2/209.13 |
| D406,442 | S * | 3/1999 | Allen | D2/892 | |
| 5,987,649 | A * | 11/1999 | Robertson | A42B 1/061 | 2/181 |
| 6,023,788 | A * | 2/2000 | McCallum | A42B 1/241 | 2/181 |
| 6,370,697 | B1 * | 4/2002 | Held | A42C 5/04 | 2/184.5 |
| D640,422 | S * | 6/2011 | Green | D29/122 | |
| 7,958,570 | B1 * | 6/2011 | Mooney | A42B 1/069 | 2/195.5 |
| 7,966,673 | B1 * | 6/2011 | Gibson | A42B 1/08 | 2/410 |
| D660,555 | S * | 5/2012 | Stoltz | D2/892 | |
| 8,457,676 | B2 * | 6/2013 | Michel | H04W 52/365 | 455/522 |
| 8,573,773 | B1 * | 11/2013 | Acosta | G02C 3/02 | 24/3.3 |
| 8,857,676 | B1 * | 10/2014 | Navarro | A42B 1/002 | 2/175.4 |
| 2005/0017040 | A1 * | 1/2005 | Roberts | A45C 13/18 | 224/617 |
| 2009/0222975 | A1 * | 9/2009 | Green | A42C 5/02 | 2/410 |
| 2011/0219522 | A1 * | 9/2011 | Petitt | A42B 1/245 | 2/422 |
| 2015/0059055 | A1 * | 3/2015 | Johnson | A42B 3/10 | 2/181.4 |
| 2015/0272256 | A1 * | 10/2015 | Meier | A42B 1/08 | 2/414 |

* cited by examiner

INSERT TO HOLD ARTICLES IN A CAP

CROSS REFERENCE TO RELATED APPLICATIONS

This application claims the priority of U.S. patent application Ser. No. 62/030,161, filed Jul. 29, 2014 which is hereby incorporated by reference in its entirety.

FIELD OF INVENTION

The present invention relates to methods and systems for an insert to hold an article in a cap.

BACKGROUND

Walkers, joggers, and exercisers all need a place hold their everyday necessities and valuables while participating in their chosen activities. People, in general, need a place to store their everyday necessities and valuables. Typical exercise and work-out apparel lacks sufficient pockets for storage of valuables such as money, keys, music players (such as mp3 players and IPODs), membership cards, credit cards, debit cards, security cards, etc. and lacks protection from identify-theft. Walkers, joggers, and exercisers may place their valuables in their shoes, hold them in their hands while participating in their activity, or leave them unattended. None of these choices are a suitable solution to this problem.

SUMMARY

Described herein are methods and systems for an insert to hold an article in a cap. The cap may be worn by a user with the insert in place in the cap. The insert does not interfere with the normal wearing of the cap by the user. In fact, the user may not even feel the insert while wearing the cap and the insert will not change an exterior appearance of the cap. The insert may be used with all baseball style hats and with most other caps and hats. The insert may also be used with all hats that have an inner band or sweatband, including, for example, cowboy style hats, panama hats, sun hats, boonie hats, etc. The insert conforms to an inner interior of the cap or hat. The insert flexes and/or bends to fit behind a sweatband or headband of the cap or the hat. The insert holds any of a variety of articles in the cap.

The insert is completely removable from the cap or hat. The same insert may be placed in different hats. The insert is versatile, and may be placed in nearly any size hat or cap. The insert has a non-disposable nature and the same insert may be moved from and reused in any number of different hats. Installation of the insert into the cap may take mere seconds. The transfer of the insert from one cap or hat to another hat or cap may also take mere seconds.

The insert includes a generally flexible or pliable member with a head side surface generally opposite of a cap side surface. The insert includes a first lateral side generally opposite of a second lateral side. The insert has an upper edge generally opposite of a lower edge. One or more extensions extend from the upper edge to form a holding region that may hold any of a variety of articles. The articles held by the insert and the holding region may include, for example, one or more of a coin, paper currency, a card, a license, music players (such as mp3 players and IPODs), other electronic devices, a key ring, a key, etc. The insert may include a lining or other material to block identity-theft. The lining or material may shield criminal readers or scanners from misappropriating information from credit cards, debits cards, etc. stored in the insert.

The insert includes the one or more extensions to hold the articles. During use of the insert, the article is placed against a portion of an inner surface of the one or more extensions. The extension is bent over the article. The extension is secured to the flexible member. The extension forms the holding region to hold the article. The insert is then flexed and positioned in the cap. The use of the insert does not generally change the appearance of all baseball style ball style hats and most caps.

In another aspect, an insert to hold an article in a cap is described. The insert includes a flexible member to generally conform to an inner surface of the cap. The flexible member has an upper surface, a lower surface, a first lateral side generally opposite of a second lateral side, and a peripheral edge. An extension extends from the peripheral edge. The extension bends over to form a holding member.

In another aspect, an insert to hold one or more articles in a cap is described. The insert includes a flexible member to generally conform to an inner surface of the cap. The flexible member has a central portion, a first lateral side extending from the central portion, and a second lateral side extending from the central portion. One or more slots are in the first lateral side, the central portion, and/or the second lateral side to hold the articles.

In another aspect, an insert to hold articles in a cap is described. The cap includes a sweatband defining a recess between the sweatband and an inner surface of the cap. An insert bends or flexes to fit into the recess. The insert includes a flexible member to generally conform to an inner surface of the cap. The flexible member has an upper surface, a lower surface, a first lateral side generally opposite of a second lateral side, and a peripheral edge. An extension extends from the peripheral edge. The extension bends over to form a holding member.

In another aspect, an insert to hold an article in a cap is described. The insert includes a flexible member having a head side surface generally opposite of a cap side surface. A first lateral side of the flexible member is generally opposite of a second lateral side of the flexible member. An upper edge of the flexible member is generally opposite of a lower edge of the flexible member. An extension extends from the upper edge. The extension defines a holding region to hold an article. The first lateral side and the second lateral side flex to form a curving or arcuate shape.

In another aspect, an insert to hold an article in a cap is described. The insert includes a central portion. A head side surface is generally opposite of a cap side surface. A first lateral side extends from the central portion. A second lateral side extends from the central portion. The central portion, the first lateral side, and the second lateral side are resiliently flexible. The insert include an upper edge and a lower edge. A first extension extends from the upper edge, and the first extension attaches to the head side surface to form a form a first holding region. A second extension extends from the upper edge. The second extension attaches to the head side surface to form a second holding region.

In another aspect, an insert to hold an article in a cap is described. The insert includes a flexible member having an upper surface, a lower surface, a first lateral side generally opposite of a second lateral side, and a peripheral edge. The flexible member has a central portion. The first lateral side extends from the central portion. The second lateral side extends from the central portion. One or more slots are in the first lateral side, the central portion, or the second lateral side to hold the article. The flexible member is configured to fit in a recess formed by a sweatband of the cap with the lower surface of the insert conforming to an inner surface of the cap.

In another aspect, a method of storing an article in a cap is described. The method includes providing an insert to hold an article in a cap. The insert includes a flexible member to generally conform to the inner surface of the cap. The flexible member has an upper surface, a lower surface, a first lateral side generally opposite of a second lateral side, and a peripheral edge. The flexible member has an extension that extends from the peripheral edge. The method includes placing an article against a portion of an inner surface of the extension. The method includes bending the extension over the article. The method includes securing the extension to the flexible member. The method includes flexing the insert. The method includes positioning the insert in the cap.

DETAILED DESCRIPTION OF INVENTION

Figure 18:
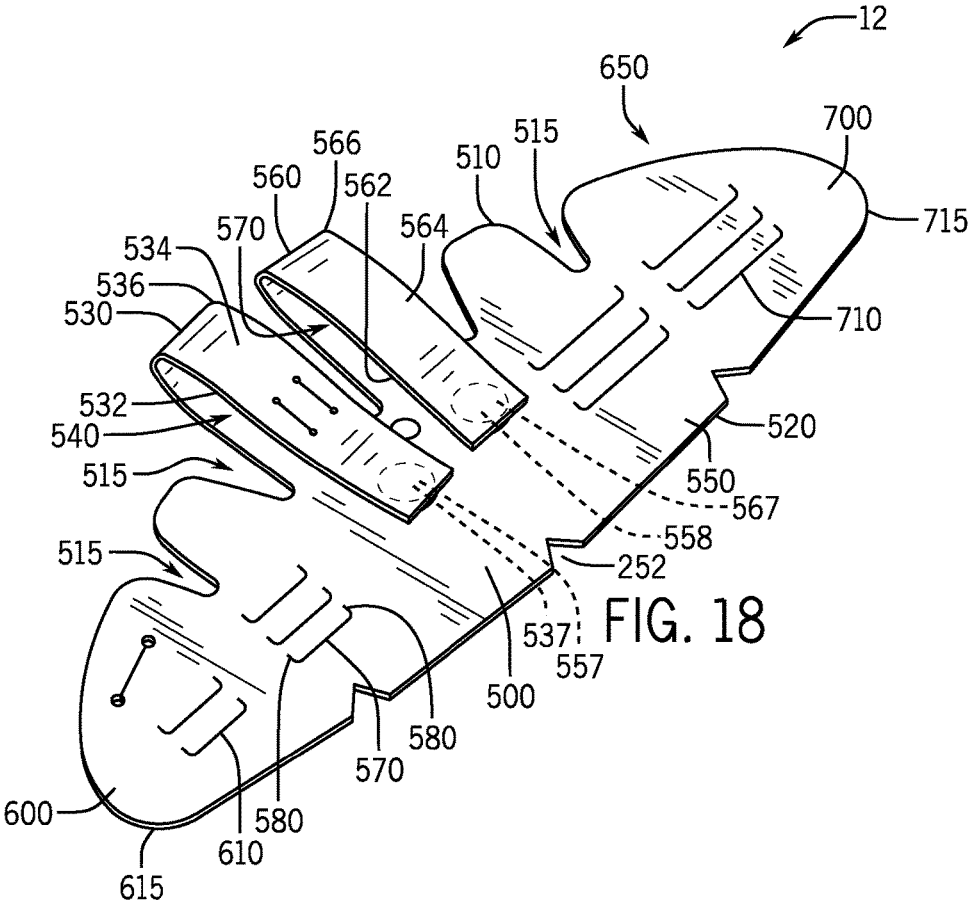
FIG. 18 is a perspective view of the third insert.
Figure 19:
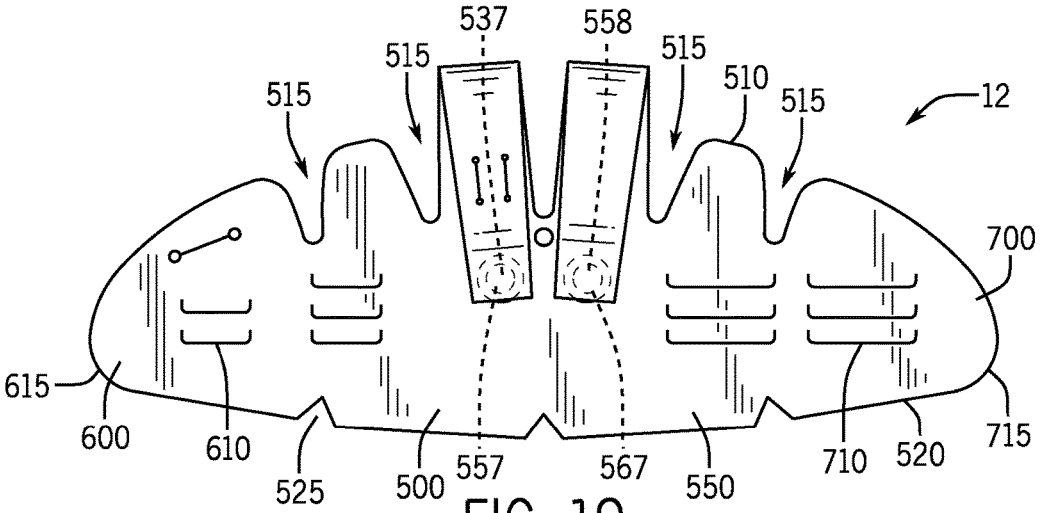
FIG. 19 is a top view of the third insert.

An insert to hold articles in a cap will now be described with reference to FIGS. 1-19. A first insert 10 to hold articles 20 in a cap 25 is shown in FIGS. 1-10. A second insert 11 to hold the articles 20 in the cap 25 is shown in FIGS. 11-17. A third insert 12 to hold the articles 20 in the cap 25 is shown in FIGS. 18-19. The inserts 10, 11, and 12 provide a universal insert that fits into most caps and hats to hold a variety of articles 20.

The insert 10 is a flexible or bendable member that fits into the cap 25 in order to hold the articles 20. The insert 10 is shaped to conform to an interior of the cap 25 and its crown. The insert 10 may be fitted into the cap 25 without modification or damage to the cap 25. The insert 10 may be moved from one cap 25 to another cap 25.

The insert 10 fits into a recess 38 between a sweatband 35 of the cap 25 and a main body 30 of the cap 25. The term "sweatband" encompasses inner bands and interior hat bands that extend around the interior of the cap 25. The insert 10 holds articles 20 in a convenient and secure manner The insert 10 may extend around approximately ¼ or approximately ½ of the circumference of the cap 25. In other styles of hats, the insert 10 may fit into a recess between an inner band of the hat and an interior surface of the hat.

The insert 10 includes a central portion 50. The insert 10 includes a first lateral side 100 that includes one or more slots 110 to hold coins 20*a*. The one or more slots 110 may pass completely through a thickness of the insert 10. The first lateral side 100 extends from the central portion 50. The first lateral side 100 forms a rounded corner edge 115.

The insert 10 include a head side or upper surface 150 generally opposite of a cap side or lower surface 250. When positioned in the cap 25, the head side surface 150 is near or touching the user's head, while the cap side surface 250 is near or touching an inner surface 40 of the cap 25. The head side surface 150 and the cap side surface 250 may form a generally smooth surface that is almost or completely unnoticeable to the wearer.

The insert 10 includes a second lateral side 200 that includes a slot 210 to hold an mp3 player 20*b*, such as an IPOD. The second lateral side 200 extends from the central portion 50. The second lateral side 200 forms a rounded corner edge 215. One or more slots 210 may be formed in one or both of the first and second lateral sides 100 and 200 and in the central portion 50.

The first lateral side 100, the central portion 50, and the second lateral side 200 may be flexed or bent to provide the insert 10 with a curved or arcuate shape. The first lateral side 100, the central portion 50, and the second lateral side 200 may be flexed or bent to conform to an interior space of or into the recess 38 behind the sweatband 35 of the cap 25. The structure of the cap 25 may generally hold the insert 10 in the curved or arcuate shape.

The insert 10 includes an upper edge 300 and a lower edge 400. The upper edge 300 and the lower edge 400 may both have an arching shape or a curved outer contour. The upper edge 300 generally has a greater arch or a greater curved outer contour than the lower edge 400 in order to properly fit into the cap 25.

The upper edge 300 includes upper edge relief cuts 310. The upper edge relief cuts 310 may have a rounder corner 315. A radius of the rounded corner 315 helps the insert 10 flex and bend without creasing, folding, or forming a point. In the aspect of FIGS. 1-17, the upper edge 300 includes four relief cuts 310. The number of relief cuts 310 may vary depending on the size and shape of the insert 10. The upper edge relief cuts 310 further angle away or widen from the rounded corner 315.

The lower edge 400 includes lower edge relief cuts 410. The relief cuts 410 help the insert 10 flex and bend without creasing, folding, or forming a point. The relief cuts 410 help the insert 10 to provide a comfortable fit. In the aspect of FIGS. 1-17, the lower edge 400 includes three relief cuts 410. In other aspects, the lower edge 400 includes approximately 2 to approximately 10 or more relief cuts 410. The number of relief cuts 410 may vary depending on the size, shape, and specific material of the insert 10.

The lower edge 400 of the insert 10 may fit into the recess 38. The sweatband 35 may cover most of the lower edge 400. When the insert 10 is installed into the cap 25, the lower edge 400 may rest against a bottom edge 39 of the recess 38. With respect to FIG. 8, a left portion of the sweatband 35 is shown as hidden in order to illustrate how the sweat band 35 holds the insert 10. The bottom edge 39 of the recess 38 supports the lower edge 400 of the insert 10, while the cap side surface 250 of the insert 10 flexes against the inner surface 40 of the cap 25.

A first extension 330 extends from the upper edge 300. The first extension 330 attaches to the head side surface 150 to form a form a first holding region 340. The first extension 330 has an inner surface 332 and an outer surface 334. The first extension 330 folds at a first bend 336. The inner surface 332 of the first extension 330 attaches to the head side surface 150 to form the first holding region 340. The inner surface 332 may include hook and loop fasteners 337 that attach to opposite hook and loop fasteners 157 on the head side surface 150. As such, the first holding region 340 may be opened to receive the article and then tightened around the article via engagement of the hold and loop fasteners 337 and 157. In other aspects, snaps, magnets, ties, etc. may be used to attach the inner surface 332 to the head side surface 150.

A second extension 360 extends from the upper edge 300. The second extension 360 attaches to the head side surface 150 to form a second holding region 370. The second extension 360 has an inner surface 362 and an outer surface 364. The second extension 360 folds at a second bend 366. The inner surface 362 of the second extension 360 attaches to the head side surface 150 to form the second holding region 370. Similarly, the inner surface 362 may include hook and loop fasteners 367 that attach to opposite hook and loop fasteners 158 on the head side surface 150, and in other aspects, snaps, magnets, ties, etc. may be used to attach the inner surface 362 to the head side surface 150.

If desired by the user, the first holding region 340 and the second holding region 370 may hold the same article. If desired by the user, the first holding region 340 and the second holding region 370 may hold different articles. For example, a driver's license, a credit card, a debit card, a security card, a gym membership card, a transponder, personal hygiene items, pharmaceutical, fishing license, sporting tickets, etc. may be held in a combination of the first holding region 340 and the second holding region 370. For example, a card 20*c* may span between the first holding region 340 and the second holding region 370. For example, the first holding region 340 and the second holding region 370 may hold or secure different portions of the same article. Children may store candy, trading cards, bandages, lunch money, emergency contact information, etc. in one or both of the first holding region 340 and the second holding region 370.

Figure 1:
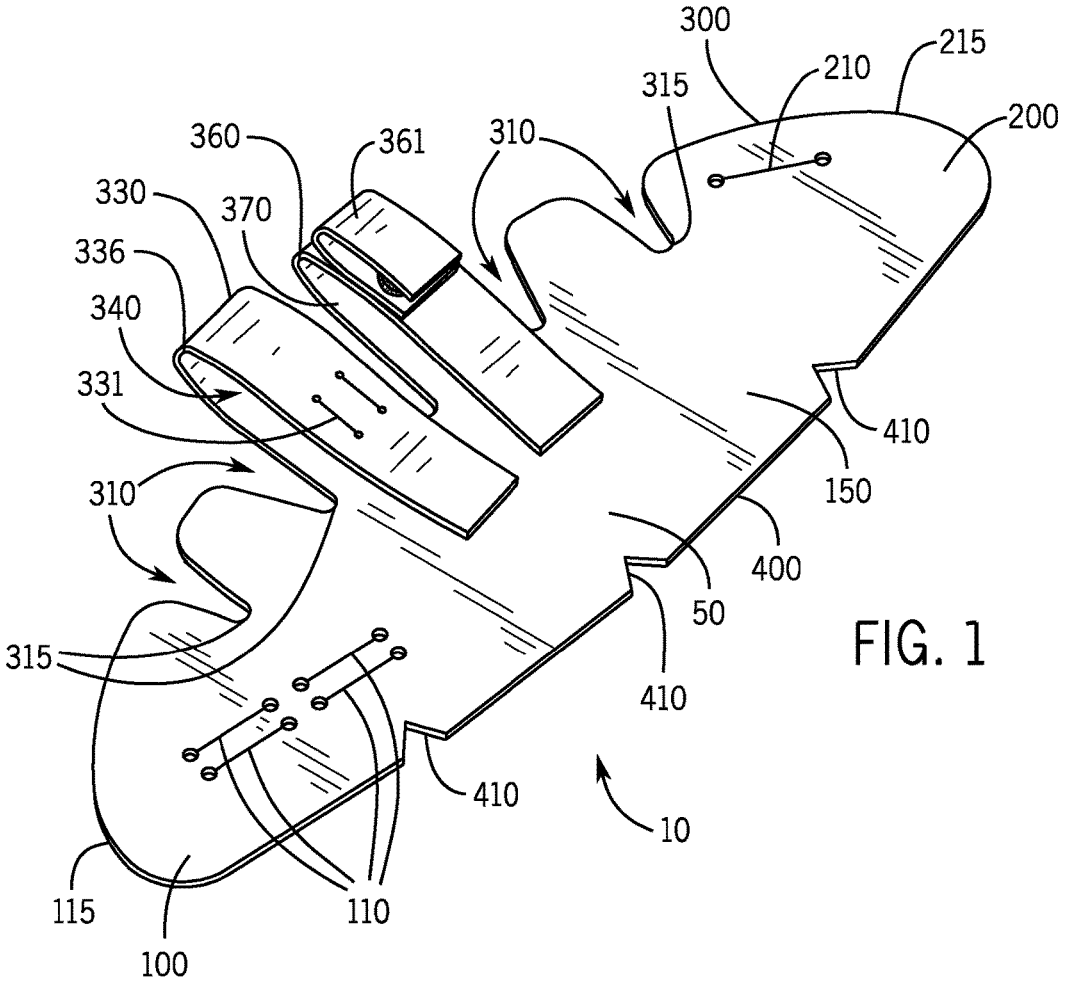
FIG. 1 is a perspective view of the insert.
Figure 2:
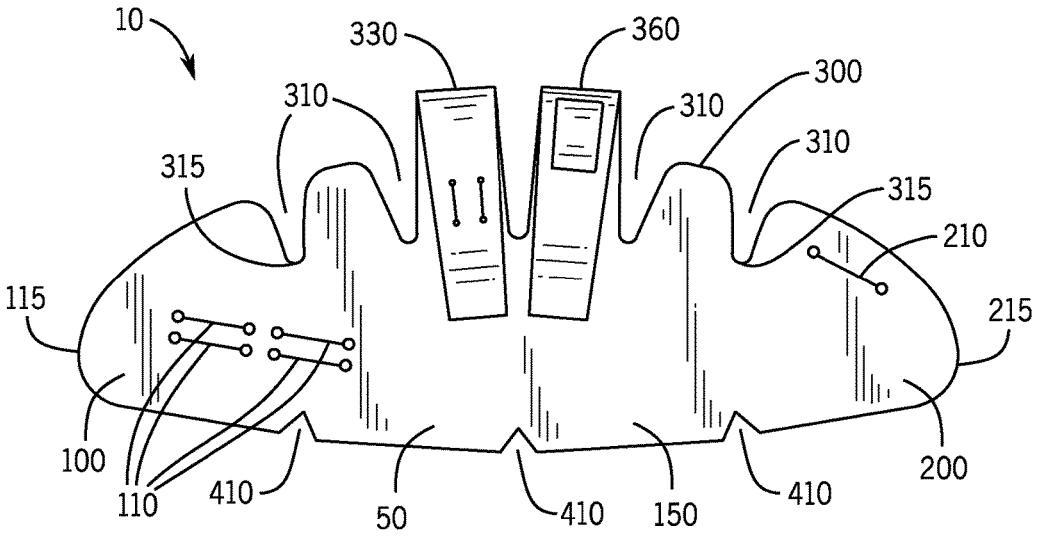
FIG. 2 is a top view of the insert.
Figure 3:
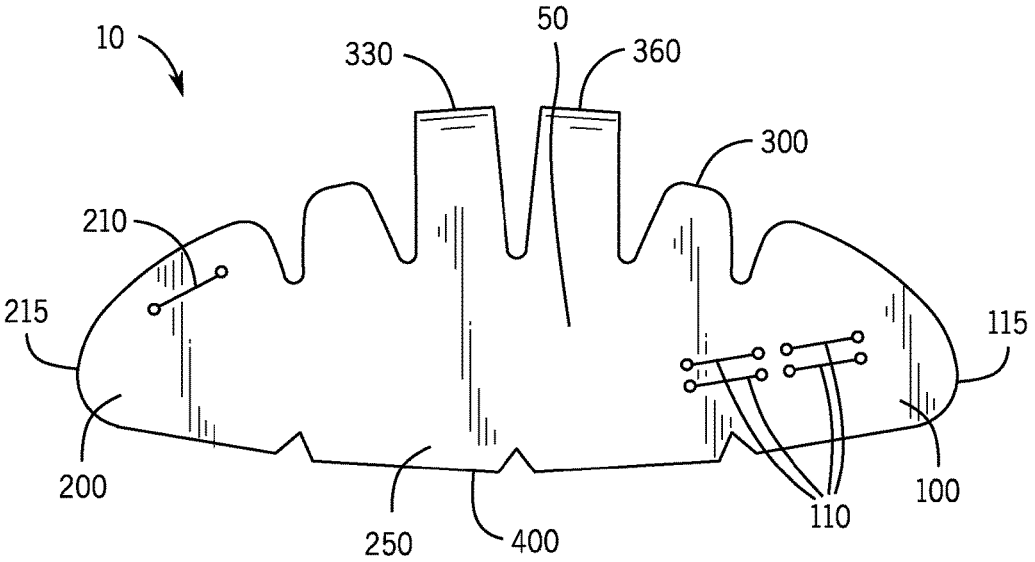
FIG. 3 is a bottom view of the insert.
Figure 4:
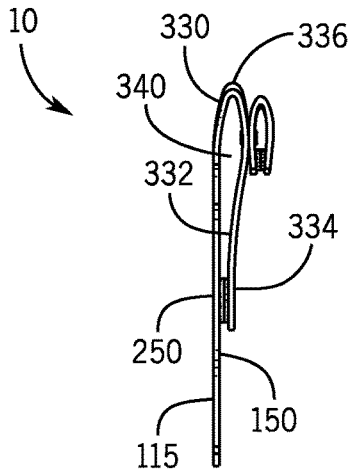
FIG. 4 is a view of the first lateral side of the insert.
Figure 5:
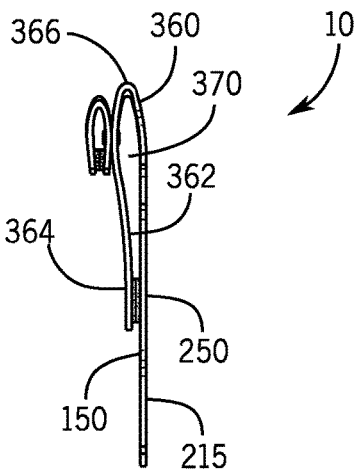
FIG. 5 is a view of the second lateral side of the insert.
Figure 6:
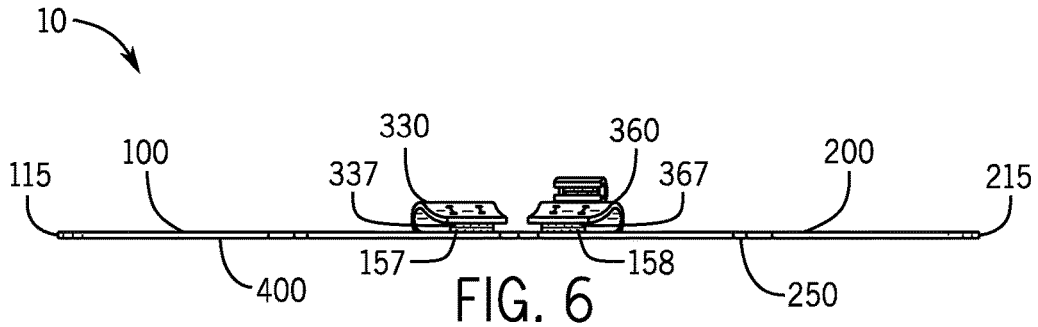
FIG. 6 is a view of lower edge of the insert.
Figure 7:
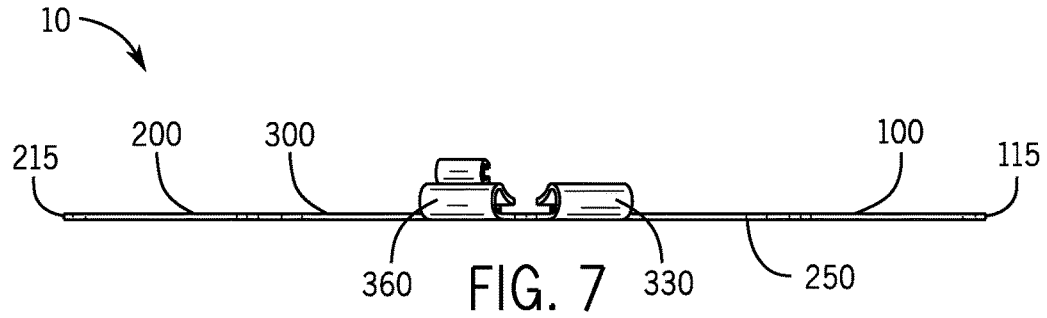
FIG. 7 is a view of upper edge of the insert.
Figure 8:
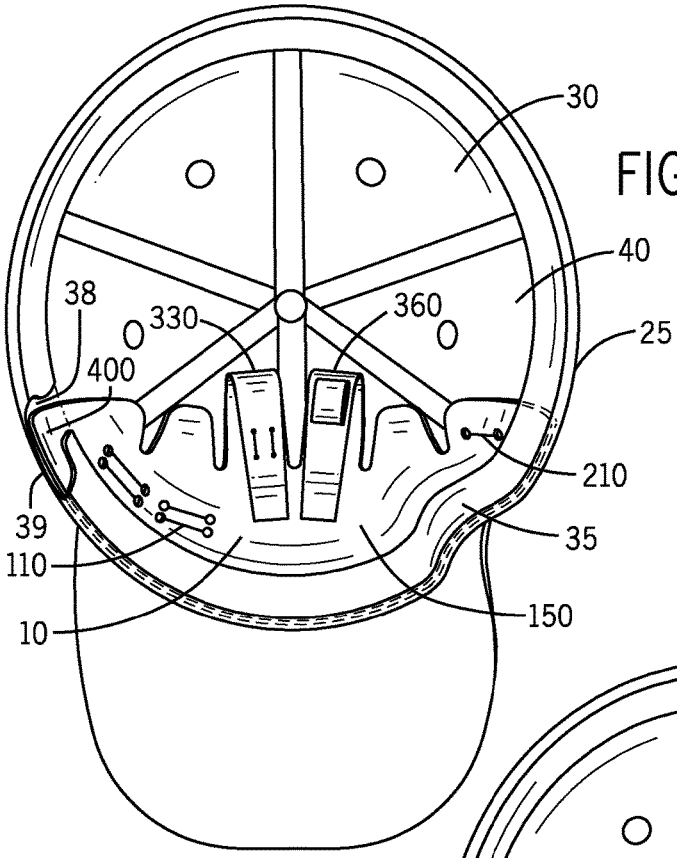
FIG. 8 is a view of the insert in the hat.
Figure 9:
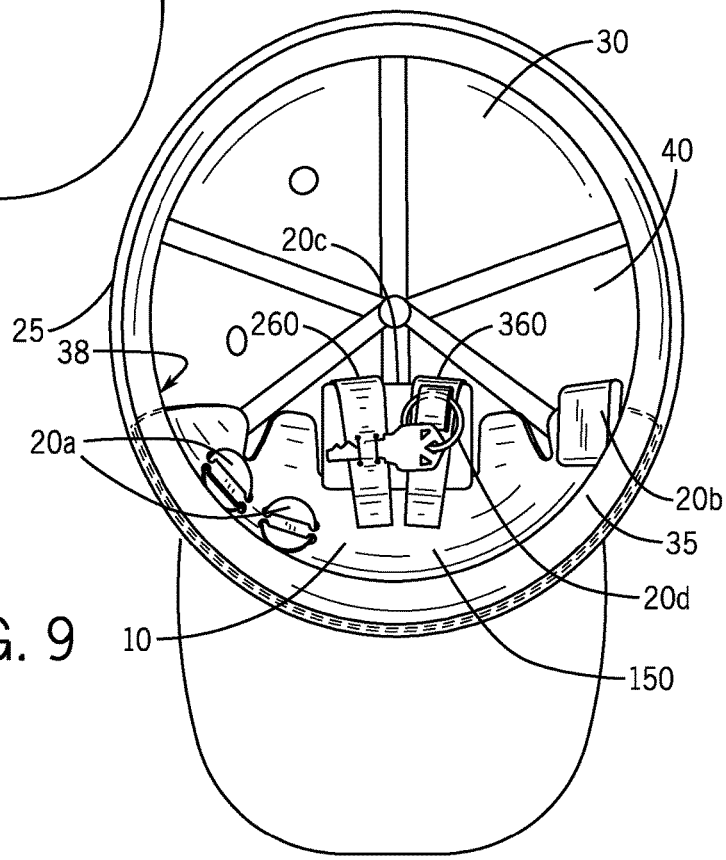
FIG. 9 is a view of the insert in the cap holding articles.
Figure 10:
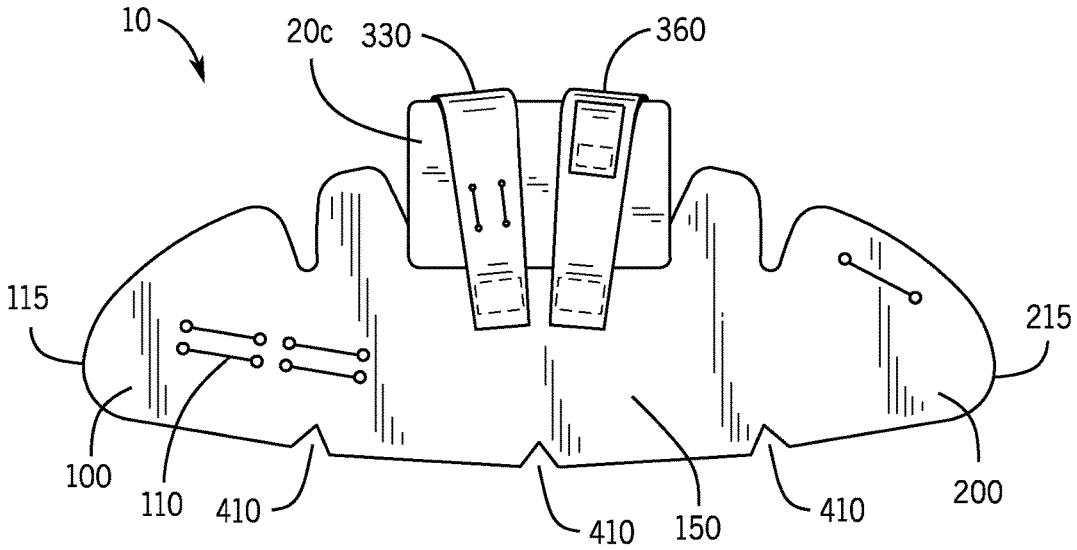
FIG. 10 is a top view of the insert holding the credit card, license, etc.
Figure 11:
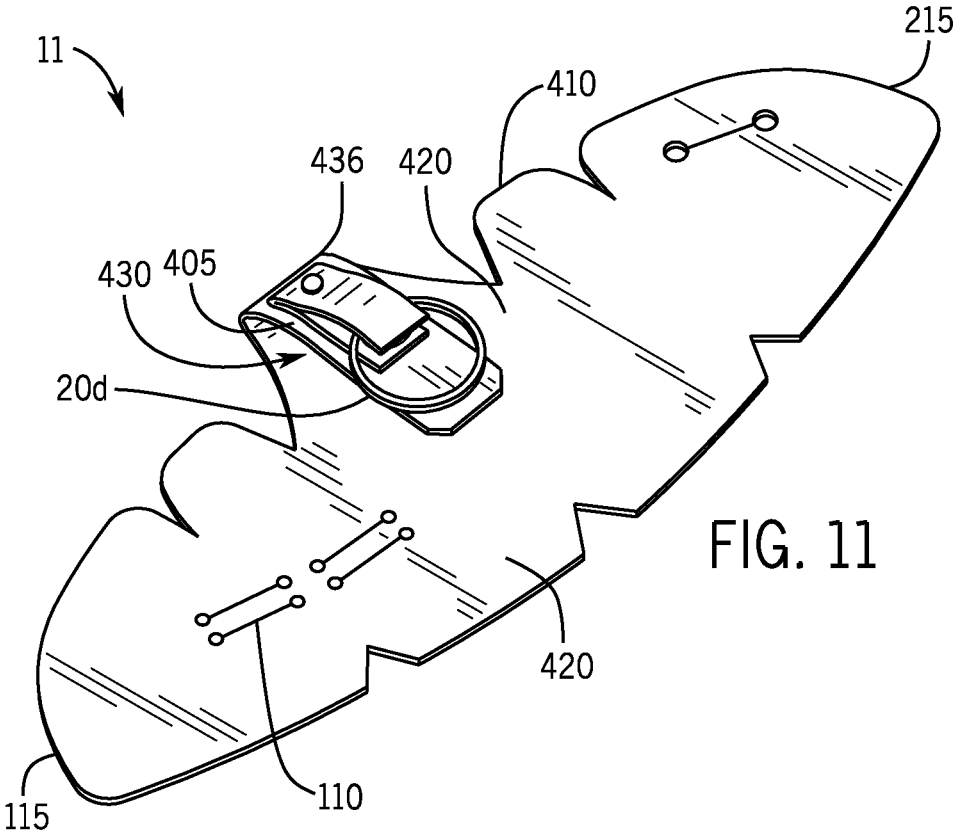
FIG. 11 is a perspective view of the second insert.
Figure 12:
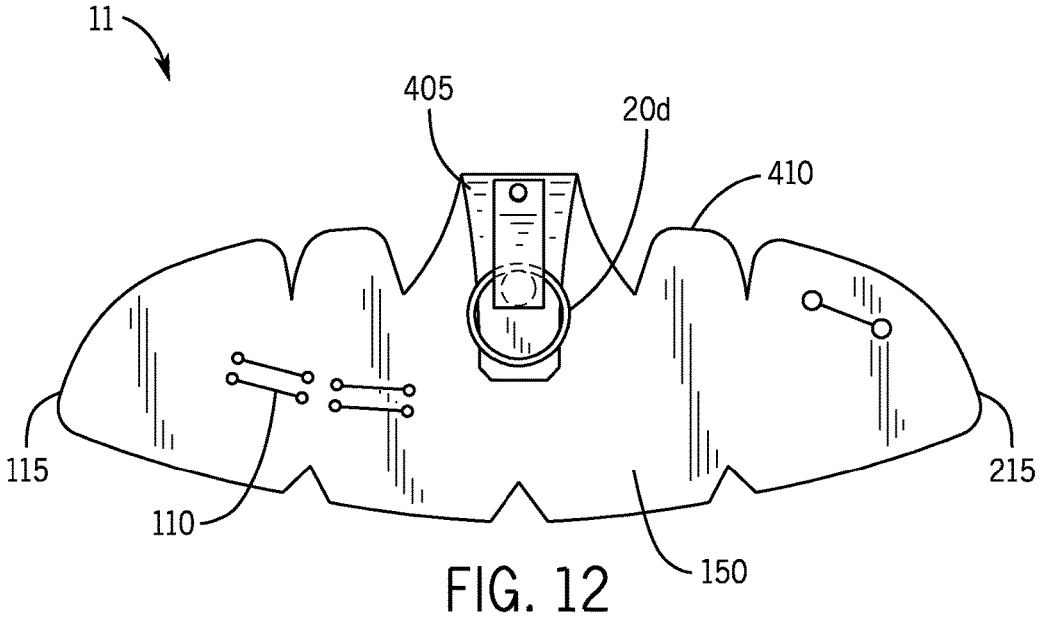
FIG. 12 is a top view of the second insert.
Figure 13:
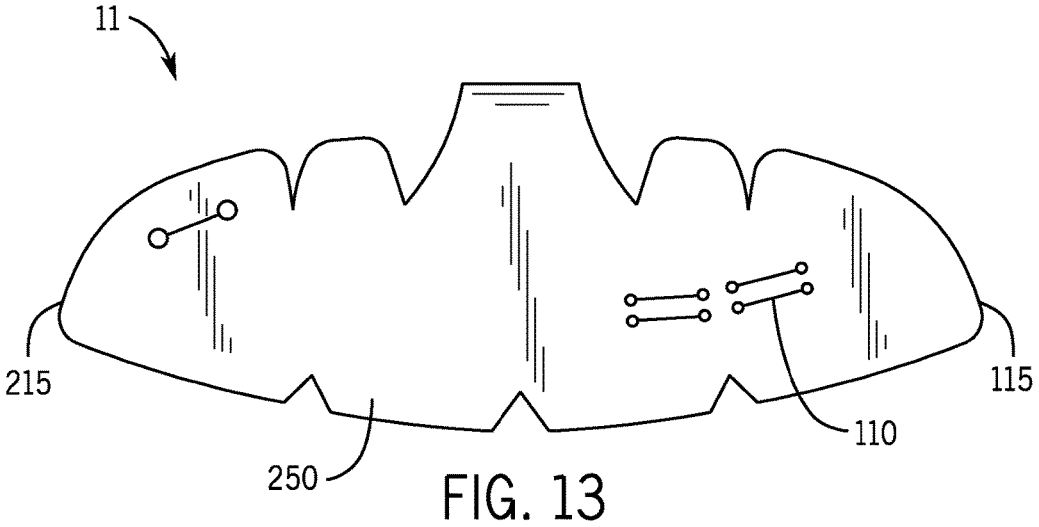
FIG. 13 is a bottom view of the second insert.
Figure 14:
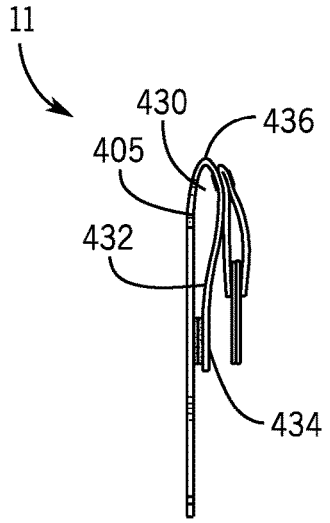
FIG. 14 is a view of the first lateral side of the second insert.
Figure 15:
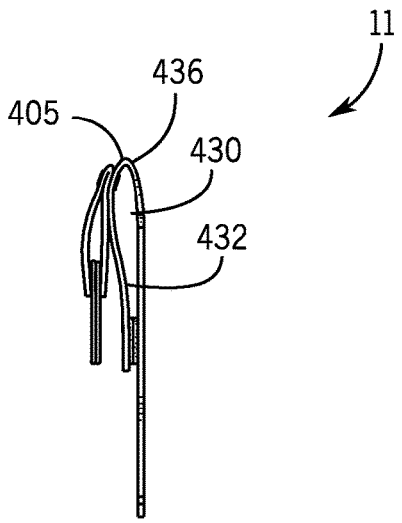
FIG. 15 is a view of the second lateral side of the second insert.
Figure 16:
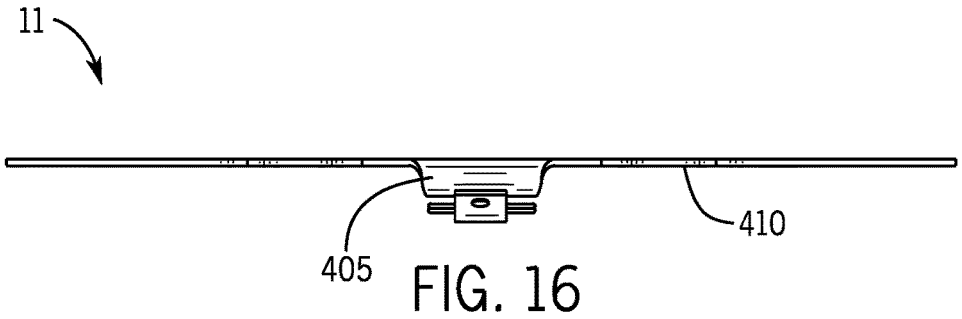
FIG. 16 is a view of the upper edge of the second insert.
Figure 17:
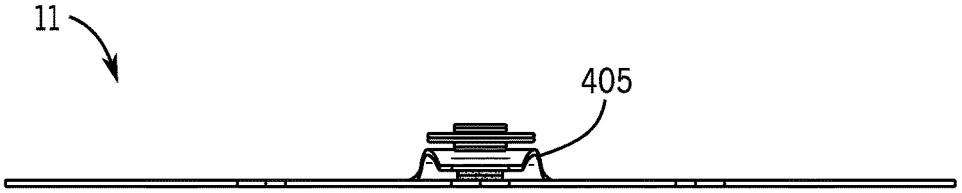
FIG. 17 is a view of the lower edge of the second insert.

One or both of the first and second extensions 330, 360 may include a secondary holding region. With reference to FIG. 9, the first extension 330 includes a key slot 331. The second extension 360 includes the secondary holding region to hold a key ring 20*d*. The key from the key ring 20*d* may fit into the key slot 33, which may accommodate both old and new key fobs. This prevents the key from dangling and distracting the wearer of the insert 10.

One or both of the first and second extensions 330, 360 may include anti-theft coatings, materials, and/or layers to prevent unauthorized scanning of credit cards contained by the insert 10.

The insert 10 is sized to fit in the cap 25. The insert 10 may have a length of approximately 6 inches to approximately 16 inches. The aspects of FIGS. 1-19 have a length of approximately 11 inches. The insert 10 may have a maximum width of approximately 2 inches to approximately 6 inches. The aspects of FIGS. 1-19 have a width of approximately 4 inches.

The insert 10 may be formed from plastic materials, such as polyethylene or other suitable plastics. The use of plastic materials provides the insert 10 with resistance to moisture. The insert 10 may also be provided with perforations, vents, or other openings to provide air flow and/or circulation. The insert 10 may have a gauge or thickness of approximately 0.010 to approximately 0.035 inches. The insert 10 may be formed from laser cutting, stamping, or other cutting processes. The insert 10 may be formed from a resiliently flexible material. The resiliently flexible nature of the insert 10 allows the insert to bend or flex in order to conform to the sweatband 35, its recess 38, and the inner surface 40 of the cap 25.

During installation of the insert 10 into the cap 25, the first lateral side 100, the central portion 50, and the second lateral side 200 flex to form a curving or arcuate shape that fits into the recess 38 or conforms to the recess 38 of the cap 25. The first lateral side 100 and the second lateral side 200 are resilient in a spring-like manner to return to a generally flat shape when the insert is removed from the recess 38. The spring or biasing nature of the insert 10 assists in maintaining or holding the insert 10 in the recess 38.

The second insert 11 will now be described with reference to FIGS. 11-17. The second insert 11 includes a similar construction, function, and shape as that of the first insert 10. The second insert 11 includes a single extension 405, which extends from an upper edge 410. The single extension 405 attaches to a head side surface 420 to form a first holding region 430. The single extension 405 has an inner surface 432 and an outer surface 434. The single extension 405 folds at a first bend 436. The inner surface 432 of the single extension 405 attaches to the head side surface 420 to form the first holding region 430.

The third insert 12 will now be described with reference to FIGS. 18-19. The third insert 12 includes a similar construction, function, and shape as that of the first insert 10 and the second insert 11. The third insert 12 includes a central portion 500. The third insert 12 includes a first lateral side 600 that includes a plurality of slots 610 to hold articles 20. The plurality of slots 610 may pass completely through a thickness of the third insert 12. The first lateral side 600 extends from the central portion 500. The first lateral side 600 forms a rounded corner edge 615.

The third insert 12 include a head side or upper surface 550 generally opposite of a cap side or lower surface 650. When positioned in the cap 25, the head side surface 550 is near or touching the user's head, while the cap side surface 650 is near or touching the inner surface 40 of the cap 25. The third insert 12 includes a second lateral side 700 that includes a plurality of slots 710 to hold articles. The second lateral side 700 extends from the central portion 500. The second lateral side 700 forms a rounded corner edge 715.

The slots 610 and 710 may include a long horizontal 570 cut through the thickness of the insert 12 and shorter vertical cuts 580 on opposite ends of the horizontal cut 570. This shape accommodates a wide variety of articles for storage in the insert 12. Further, the slots 610 or 710 may be spaced in close proximity such that an article may pass through multiple slots 610 or 710.

The first lateral side 600, the central portion 500, and the second lateral side 700 may be flexed or bent to provide the third insert 12 with a curved or arcuate shape. The first lateral side 600, the central portion 500, and the second lateral side 700 may be flexed or bent to conform to an interior space of or into the recess 38 behind the sweatband 35 of the cap 25. The structure of the cap 25 may generally hold the third insert 12 in the curved or arcuate shape.

The third insert 12 includes an upper edge 510 and a lower edge 520. The upper edge 510 and the lower edge 520 may both have an arching shape or a curved outer contour. The upper edge 510 generally has a greater arch or a greater curved outer contour than the lower edge 520 in order to properly fit into the cap 25.

The upper edge 510 includes upper edge relief cuts 515. The upper edge relief cuts 515 may have a rounder corner 517. A radius of the rounded corner 517 helps the third insert 12 flex and bend without creasing, folding, or forming a point. In the aspect of FIGS. 18-19, the upper edge 510 includes four relief cuts 515. The number of relief cuts 515 may vary depending on the size and shape of the third insert 12. The upper edge relief cuts 515 further angle away or widen from the rounded corner 517.

The lower edge 520 includes lower edge relief cuts 525. The relief cuts 525 help the third insert 12 flex and bend without creasing, folding, or forming a point. The relief cuts 525 help the third insert 12 to provide a comfortable fit. In the aspect of FIGS. 18-19, the lower edge 520 includes three relief cuts 525.

The lower edge 520 of the third insert 12 may fit into the recess 38. The sweatband 35 may cover most of the lower edge 520. When the third insert 12 is installed into the cap 25, the lower edge 520 may rest against the bottom edge 39 of the recess 38.

A first extension 530 extends from the upper edge 510. The first extension 530 attaches to the head side surface 550 to form a form a first holding region 540. The first extension 530 has an inner surface 532 and an outer surface 534. The first extension 530 folds at a first bend 536. The inner surface 532 of the first extension 530 attaches to the head side surface 550 to form the first holding region 540. The inner surface 532 may include hook and loop fasteners 537 that attach to opposite hook and loop fasteners 557 on the head side surface 550. As such, the first holding region 540 may be opened to receive the article and then tightened around the article via engagement of the hold and loop fasteners 537 and 557. A second extension 560 extends from the upper edge 510. The second extension 560 attaches to the head side surface 550 to form a second holding region 570. The second extension 560 has an inner surface 562 and an outer surface 564. The second extension 560 folds at a second bend 566. The inner surface 562 of the second extension 560 attaches to the head side surface 550 to form the second holding region 570. Similarly, the inner surface 562 may include hook and loop fasteners 567 that attach to opposite hook and loop fasteners 558 on the head side surface 550.

In other aspects, the inserts 10, 11, 12 may include additional extensions, additional relief cuts, other holding slots, and other holding regions. Additional fastening members may be permanently or temporarily engaged to the inserts 10, 11, and 12. For example, a clear plastic sheet of material may be affixed to the head side surface 150, 420, or 550 in order to form a see-through pocket or envelope. For example, additional pieces of hook and loop fastener may be attached to the head side surface 150, 420, or 550 in order to engage articles also having hook and loop fasteners. For example, other retaining devices, such as, straps, bands, loops, holders, tabs, clips, rings, etc. may be attached or affixed to either the cap side surface 250, 650 or the head side surface 150 or 420. For example, other openings may be formed in the thickness of the inserts 10, 11, or 12 customized to hold specific articles (e.g., 4 small openings may be formed in the thickness of the insert 10, 11, or 12 to hold the four corners of a driver's license, credit card, stored value cardm identification card, and the like. In other aspects, the inserts 10, 11, and 12 may include any of a variety of graphics, advertisements, branding, UPC codes, game schedules etc. that may be printed or displayed on the surfaces of the insert 10, 11, and 12.

What is claimed is:

1. An insert for holding an article in a hat including a crown having an interior and an exterior opposite the interior, an opening sized for receiving a portion of a wearer's head in the interior, and a sweatband having a curved shape surrounding the opening for engaging the wearer's head, said insert comprising:

a central portion;

a left lateral side portion extending leftward from the central portion to a left edge;

right lateral side portion extending rightward from the central portion to a right edge opposite the left edge;

a lower edge sized extending laterally between the left edge and the right edge for insertion between the crown and the sweatband of the hat, said lower edge having an arcuate shape corresponding to the curved shape of the sweatband when inserted in the interior of the hat between the crown and the sweatband;

an upper edge extending laterally between the left edge and the right edge, said upper edge being positioned in the interior of the crown above the lower edge when the lower edge is inserted in the interior of the hat between the crown and the sweatband;

a hat-side surface extending from the upper edge to the lower edge and from the left edge to the right edge, said hat-side surface having a convex shape and facing the crown when the lower edge is inserted in the interior of the hat between the crown and the sweatband;

a head-side surface extending downward from the upper edge to the lower edge and laterally from the left edge to the right edge, said head-side surface having a concave shape and facing opposite the crown and toward the wearer's head when the lower edge is inserted in the interior of the hat between the crown and the sweatband;

an extension extending from the upper edge to an attachment portion, said extension being adapted for and selectively bendable between the upper edge and the attachment portion so the attachment portion of the extension overlies the head-side surface and the article; and a fastener for attaching the attachment portion of the extension to said one of the head-side surface or the hat-side surface thereby forming a first article holding region for holding the article inside the hat.

2. An insert as set forth in claim 1, wherein:

the extension is selectively bendable between the upper edge and the attachment portion so the attachment portion of the extension overlies the head-side surface; and the fastener is adapted to attach the attachment portion of the extension to the head-side surface thereby forming the first article holding region.

3. An insert as set forth in claim 1, wherein the first article holding region is adapted to hold at least one item selected from a group of items consisting of a coin, paper currency, a card, a license, a music player, an electronic device, a key ring, and a key.

4. An insert as set forth in claim 1, wherein at least one of said central portion, said left lateral side portion, said right lateral side portion, and said extension includes a slot forming a second article holding region for holding the article inside the hat.

5. An insert as set forth in claim 1, wherein at least one of said central portion, said left lateral side portion, and said right lateral side portion is flexible for selective movement between a flat configuration and a curved configuration in which the lower edge has the curved shape corresponding to the sweatband for insertion in the interior of the hat between the crown and the sweatband.

6. An insert as set forth in claim 5, wherein the at least one of said central portion, said left lateral side portion, and said right lateral side portion is sufficiently resilient to return to the flat configuration when the lower edge is removed from the interior of the hat.

7. An insert as set forth in claim 1, wherein at least one of the upper edge and the lower edge includes a relief cut.

8. An insert as set forth in claim 1, wherein the fastener is a hook-and-loop fastener.

9. An insert as set forth in claim 1, wherein the fastener is selectively releasable for releasing the article from the first article holding region.

10. An insert as set forth in claim 9, wherein the extension extends from the upper edge above the central portion.

11. An insert as set forth in claim 10, wherein the insert is selectively bendable so the attachment portion of the extension overlies the head-side surface of the central portion.

12. An insert as set forth in claim 9, wherein the insert is selectively bendable so the attachment portion of the extension overlies the head-side surface of the central portion.

13. An insert as set forth in claim 1, wherein said extension constitutes a first extension and the insert further comprises a second extension extending from the upper edge forming a second article holding region.

14. An insert as set forth in claim 13, wherein said first article holding region and said second article holding region are adapted to simultaneously hold a single item.

15. An insert as set forth in claim 13, wherein said first extension includes a key slot and said second extension includes a secondary article holder adapted for a key ring.

16. An insert as set forth in claim 1, wherein said extension includes a secondary article holder.

17. An insert for holding an article in a hat including a crown having an interior and an exterior opposite the interior, an opening sized for receiving a portion of a wearer's head in the interior, and a sweatband having a curved shape surrounding the opening for engaging the wearer's head, said insert comprising:

a left edge;

a right edge opposite the left edge;

a lower edge sized extending laterally between the left edge and the right edge for insertion between the crown and the sweatband of the hat, said lower edge having an arcuate shape corresponding to the curved shape of the sweatband when inserted in the interior of the hat between the crown and the sweatband;

an upper edge having a bowed shape extending laterally between the left edge and the right edge, said upper edge being positioned in the interior of the crown above the lower edge when the lower edge is inserted in the interior of the hat between the crown and the sweatband;

a hat-side surface extending laterally between the left edge and the right edge and vertically from the upper edge to the lower edge, said hat-side surface having a convex shape in conformance with the arcuate shape adjacent the lower edge and with the bowed shape adjacent the upper edge, said hat-side surface facing the crown when the lower edge and is inserted in the interior of the hat between the crown and the sweatband;

a head-side surface extending laterally between the left edge and the right edge and vertically from the upper edge to the lower edge, said head-side surface having a concave shape facing opposite the crown and toward the wearer's head when the lower edge is inserted in the interior of the hat between the crown and the sweatband;

an extension extending from the upper edge to an attachment portion, said extension being adapted for and selectively bendable between the upper edge and the attachment portion so the attachment portion of the extension overlies the head-side surface and the article; and a fastener for attaching the attachment portion of the extension to said head-side surface thereby forming a first article holding region for holding the article inside the hat.

18. An insert as set forth in claim 17 in combination with said hat.

19. A method of storing an article in a hat, comprising:

positioning the article against a head-side surface of an insert including a member sized for insertion inside a hat between a crown and a sweatband of the hat, said insert having a flexible extension extending from an upper edge of the member to an attachment portion, said extension being selectively bendable to a position in which the attachment portion of the extension overlies the head-side surface;

bending the extension over the article so the attachment portion of the extension overlies the head-side surface;

fastening the attachment portion to the member to hold the article in position against the head-side surface of the insert; and inserting the member of the insert having the article held in position against the head-side surface in the hat between a crown and a sweatband of the hat.

20. A method as set forth in claim 19, further comprising flexing the member to a shape corresponding to the sweatband of the hat before inserting the member in the hat between a crown and a sweatband of the hat.

* * * * *